United States Patent [19]

Meadows

[11] 4,398,330

[45] Aug. 16, 1983

[54] CENTER PLATE STRUCTURE FOR RAILWAY VEHICLE

[75] Inventor: Roger D. Meadows, Waynesville, N.C.

[73] Assignee: Dayco Corporation, Dayton, Ohio

[21] Appl. No.: 260,880

[22] Filed: May 6, 1981

[51] Int. Cl.[3] ..... B21D 53/10; B61F 5/18; F16C 17/04

[52] U.S. Cl. ..... 29/149.5 C; 29/149.5 NM; 29/451; 105/199 C

[58] Field of Search ..... 105/199 C, 199 CB; 308/137, 138; 29/149.5 C, 149.5 NM, 451

[56] References Cited

U.S. PATENT DOCUMENTS

| | | | |
|---|---|---|---|
| 2,258,640 | 10/1941 | Beckette | 105/199 C X |
| 2,356,246 | 8/1944 | Jones | 105/199 C X |
| 3,218,989 | 11/1965 | Kreiner et al. | 105/199 C X |
| 3,713,710 | 1/1973 | Wallace | 105/199 C X |
| 4,188,888 | 2/1980 | Cooper et al. | 105/199 C |

*Primary Examiner*—Bruce H. Stoner, Jr.
*Assistant Examiner*—Howard Beltran
*Attorney, Agent, or Firm*—Joseph V. Tassone

[57] ABSTRACT

A method of resisting wear between a body center plate of a body bolster of a railway vehicle body and a bolster bowl of a truck bolster of a truck of the railway vehicle is provided by disposing a wear resistant tubular liner to be sandwiched between the cylindrical surfaces of the body center plate and the bolster bowl. The tubular liner comprises an ultra high molecular weight polymeric material and has a top surface. A continuous metal ring is fixed to the flange of the bolster bowl against a top portion of the inside surface thereof before the liner is disposed in such bowl. The ring serves to engage the top surface of the tubular liner and prevent vertical cold flow of the polymeric material thereof from between the cylindrical surfaces.

6 Claims, 6 Drawing Figures

CENTER PLATE STRUCTURE FOR RAILWAY VEHICLE

BACKGROUND OF THE INVENTION

1. Field of the Invention

This invention relates to center plate structure for a railway vehicle which utilizes a polymeric wear-resistant tubular liner.

2. Prior Art Statement

It is known in the art to provide a railway vehicle having a body provided with a body bolster and a body center plate with the body center plate having a supported planar bottom surface adjoined by a cylindrical outside surface, a truck provided with a truck bolster and a bolster bowl with the bolster bowl having a planar supporting surface adjoined by an upstanding peripheral flange which has a cylindrical inside surface which is adapted to receive the outside surface therewithin, and a wear-resistant tubular liner disposed in sandwiched relation between the cylindrical surfaces with the body center plate disposed within the bolster bowl.

For example, see the following patents:

(1) U.S. Pat. No. 4,188,888, and (2) U.S. Pat. No. 3,218,989.

It appears from item (1) that a polymeric wear-resistant tubular liner is provided between the above-mentioned cylindrical inside and outside surfaces. However, there is no teaching of confining the polymeric material comprising this liner to prevent vertical cold flow thereof from between the cylindrical surfaces.

It appears from item (2) that a metallic wear band is provided between the above-mentioned cylindrical inside and outside surfaces wherein such band has a gap in its circumference and is held against vertical movement by spaced lugs. However, such a metallic wear band has comparatively poor antifriction properties and the lugs do not engage the entire top surface of the band and have substantial gaps therebetween.

The exemplary patents mentioned above highlight that railway vehicle center plate structures proposed heretofore are deficient in that each of such structures either does not employ a tubular liner made of a suitable wear resistant material or when made of a suitable polymeric wear resistant material such liner is not held in position to prevent vertical cold flow of the polymeric material comprising same.

However, see the U.S. patent to Wallace, U.S. Pat. No. 3,713,710 wherein metallic liners are held in place in their respective bolster bowls by retainers rings welded in place after the respective liners have been inserted into their respective bolster bowls.

It is an object of this invention to provide an improved wear resistant structure between a body center plate provided on a body bolster of a railway vehicle body and a bolster bowl provided on a truck bolster of a truck of the railway vehicle.

Another object of this invention is to provide an improved method of resisting wear between such a railway vehicle body center plate and associated railway truck bolster bowl.

Other aspects, embodiments, objects, and advantages of this invention will become apparent from the following specification, claims, and drawing.

SUMMARY

In accordance with the present invention there is provided an improved railway vehicle center plate structure which overcomes the above-mentioned deficiencies. The improved structure is provided on a railway vehicle having a body provided with a body bolster and a body center plate with the body center plate having a supported planar bottom surface adjoined by a cylindrical outside surface, a truck provided with a truck bolster and a bolster bowl with the bolster bowl having a planar supporting surface adjoined by an upstanding peripheral flange which has a cylindrical inside surface which is adapted to receive the outside surface therewithin, and a wear resistant tubular liner disposed in sandwiched relation between the cylindrical surfaces with the body center plate disposed within the bolster bowl and with the tubular liner being comprised of an ultra high molecular weight polymeric material and having a top surface.

In accordance with one embodiment of this invention a continuous metal ring is fixed to the above-mentioned flange against a top portion of the inside surface before the liner is disposed in the bowl with the ring subsequently serving to engage the top surface of the tubular liner and prevent vertical cold flow of the polymeric material comprising same from between the cylindrical surfaces.

Also provided in accordance with this invention is a truck for a railway vehicle having a truck bolster and a bolster bowl with the bolster bowl having a planar supporting surface and an adjoining upstanding peripheral flange which has a cylindrical inside surface with the bolster bowl being adapted to receive therewithin a body center plate provided on a body bolster comprising a body of the vehicle and with the body center plate having a supported planar bottom surface adjoined by a cylindrical outside surface, a wear resistant tubular liner disposed in sandwiched relation between the cylindrical surfaces with the body center plate disposed within the bolster bowl and with the tubular liner comprising an ultra high molecular weight polymeric material, and a continuous metal ring fixed to the flange against a top portion of its inside surface before the liner is disposed in the bowl with the ring subsequently serving to engage a top surface of the liner and prevent vertical cold flow of the polymeric material comprising same from between the cylindrical surfaces.

Also provided in accordance with this invention is an improved method of resisting wear between a body center plate provided on a body bolster of a railway vehicle body and an associated bolster bowl provided on a truck bolster of a truck of the railway vehicle.

BRIEF DESCRIPTION OF THE DRAWING

The accompanying drawing shows present preferred embodiments of this invention, in which.

DETAILED DESCRIPTION

Figure 1:
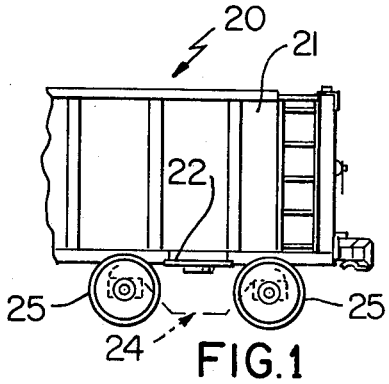
FIG. 1 is a fragmentary view in elevation illustrating an end portion of an exemplary railway vehicle, which is shown as a railway car, with the wheels of an associated truck at the one end thereof being illustrated by solid lines, and the outline of the remainder of the truck by dot-dash lines.

Reference is now made to FIG. 1 of the drawing which illustrates an end portion of a railway vehicle, which is shown in this example as a railway car and which is designated generally by the reference numeral 20. The car 20 has a car body 21 which is provided with a pair of body bolsters 22 at opposite ends thereof, with only one bolster 22 being shown in FIG. 1. Each body bolster 22 has a body center plate 23 comprising same; and, as is known in the art, the entire load of the car body 21 is carried through its bolsters 22 and body center plates 23 to railway trucks 24 at opposite ends of the car body 21.

Figure 2:
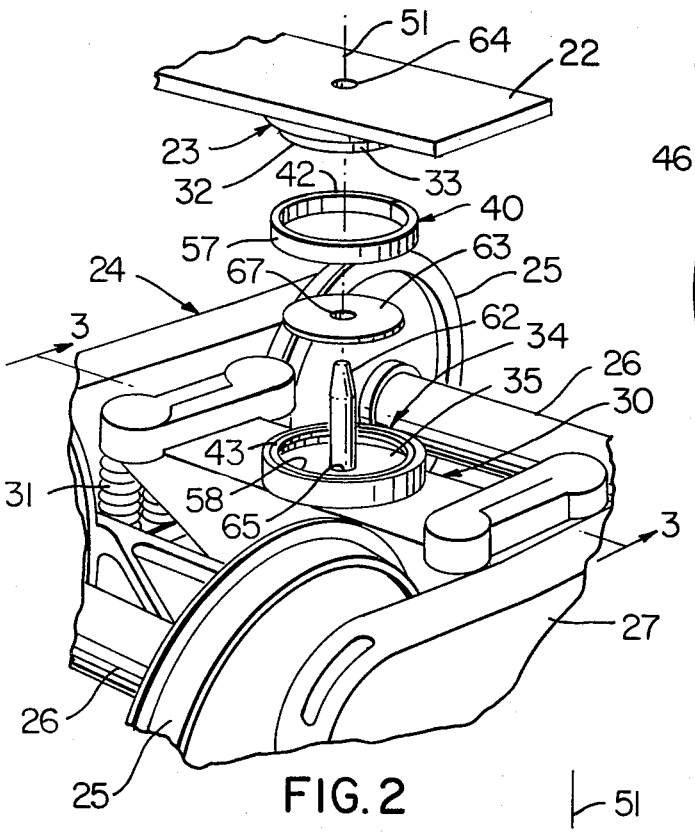
FIG. 2 is a fragmentary isometric view particularly illustrating a body bolster and body center plate of the vehicle body of FIG. 1, the associated railway truck with its bolster and bolster bowl, and other components of the center plate structure associated with the body center plate and bolster bowl.

The outline of a typical railway truck 24 between wheels thereof is shown in FIG. 1 by dot-dash lines, for simplicity and ease of presentation; and, a central portion of such truck is illustrated in isometric view in FIG. 2. The following description of the truck 24 and components associated therewith is fully applicable to both trucks of the railway car 20. Also the description, to be presented subsequently, of the car body bolster 22 and its body center plate 23 is also fully applicable to both center plates.

The truck 24 has the usual four wheels 25 and a fragmentary portion of only three of such wheels is illustrated. The truck 24 also has an axle 26 which extends between each associated pair of wheels 25; and, the truck 24 has a structural frame assembly 27 which is carried by the axles 26 and such axles and their wheels are freely rotatable while carrying the frame assembly. The frame assembly 27 carries a truck bolster 30 employing resilient mounting means, which are shown in this example as compression spring sets 31, at opposite sides of the truck 24.

The car body center plate 23 is provided on its car body bolster 22 as is known in the art and has a supported planar bottom surface 32 adjoined by a cylindrical outside surface 33. The body bolster 22 is structurally fixed to the car body 21 using techniques which are known in the art.

Figure 3:
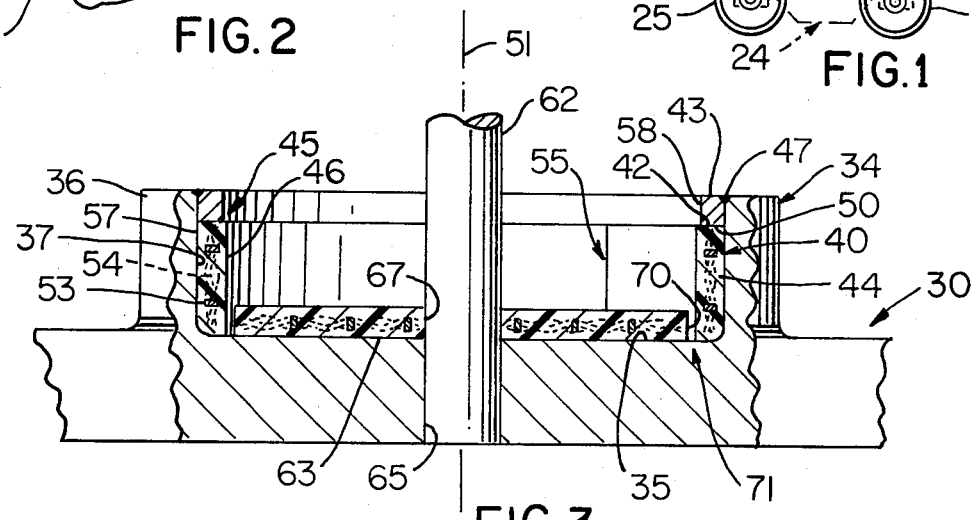
FIG. 3 is a view with parts in elevation, parts in cross section, and parts broken away taken essentially on the line 3—3 of FIG. 2.

As previously mentioned, the truck 24 is provided with a truck bolster 30 and a bolster bowl 34. As best seen in FIG. 3 of the drawing, the bolster bowl has a circular planar supporting surface 35, which is often referred to as a truck center plate, adjoined by an upstanding peripheral flange 36 which has a right circular cylindrical inside surface 37; and the surface 37 is adapted to receive the cylindrical outside surface 33 of the car body center plate 23 therewithin. A wear resistant tubular liner 40 is provided and disposed in sandwiched relation between the cylindrical surfaces 33 and 37 with the body center plate 23 disposed within the bolster bowl 34. The tubular liner 40 will be described in more detail subsequently, but basically such tubular liner has a substantially right circular cylindrical configuration provided with a top planar annular surface 42 and is comprised of an ultra high molecular weight polymeric material 44.

In accordance with the teachings of this invention a continuous metal ring 43 is fixed to the flange 36 against a top portion of the inside surface 37 thereof. This reference to a continuous ring 43 is intended to define the fact that the ring is free of gaps at any location in its circumference once it is installed in position. The metal ring 43 serves to engage the top surface 42 of the tubular liner 40 and prevent vertical cold flow of the polymeric material comprising same from between the cylindrical surfaces 33 and 37. It will be appreciated that such vertical cold flow of the polymeric material 44 of the liner 40 might possibly occur without the presence of the metal ring 43 due to the comparatively large compressive forces exerted by the surfaces 33 and 37 against the associated surfaces of the ring 40 during normal operation of the railway car 20.

The liner 40 has a radial thickness which is initially substantially greater than the radial thickness of the metal ring 43 as shown at 45 in FIG. 3; however, during extended operation of the car 20 the greater thickness of the liner will gradually wear down.

Once the wear is such that the greater thickness of the liner 40 at 45 is eliminated, the metal ring 43 is engaged by metal surface 33 and is worn at a substantially more rapid rate whereby the right circular cylindrical inside surface 46 of the tubular liner 40 then proceeds to receive the wear. Because of the comparatively larger wear rate of metal as compared with the ultra high molecular weight polymeric material 44, the liner 40 operates to perform its wear resisting function.

The ring 43 may be made of any suitable metallic material known in the art; however, preferably such ring is made of a ferrous metal which is compatible with the ferrous metal used in making the flange 36 of the bolster bowl 34. Further, although the metal ring 43 may be fixed to the flange 36 using any technique known in the art, in this example such ring is preferably fixed in position by suitable metal weld means 47.

The metal ring 43 has a continuous annular bottom surface 50 which is adapted to be engaged by the top surface 42 of the tubular liner and prevent cold flow of the polymeric material 44 comprising such liner during operation of the car 20. The bottom surface 50 in the illustration of FIGS. 2 and 3 of the drawing is disposed perpendicular to a central vertical axis 51 through the bolster bowl 34.

The tubular liner 40 may be a reinforced liner or such liner may be free of reinforcing material as will be described subsequently. The liner 40 of FIG. 3 is shown as a reinforced liner and is preferably reinforced by metal structure 53 which is embedded within the polymeric material 44 defining such liner and the metal structure has spaced openings 54 therein. In accordance with the teachings of U.S. Pat. No. 4,188,888 (the disclosure of which is incorporated in this application by reference thereto) the metal structure 53 may be a grid-like structure preferably in the form of an expanded metal structure which has the openings 54 defined therein as an integral part thereof. The polymeric material 44 serves as a matrix for the metal structure 53 and such polymeric material extends completely through the openings 54 and substantially completely surrounds the metal structure 53. The metal structure 53 also serves to help prevent cold flow of the polymeric material 44; however, some cold flow may occur vertically between the surfaces 33 and 37 due to the high loads applied during operation of the car. The metal ring 43 of this invention is used in combination with the components associated therewith to prevent such cold flow.

The liner 40 has a substantially right circular cylindrical configuration of a given outside diameter and a cut extending completely through the vertical height and thickness of such liner. The cut is illustrated at 55 in FIG. 4 with the cut ends being spread apart to highlight such cut. The cut at 55 defines a pair of free ends 56 of the liner and the free ends are adapted to be moved past each other to enable application of radially inwardly compressive forces against the liner to define an outside diameter which is smaller than the given diameter or original diameter of the liner. This defining of a smaller outside diameter facilitates movement of the liner 40 past the inside cylindrical surface 58 (FIG. 3) of the metal ring 43. Further, the polymeric material 44 and metal structure 53 comprising the liner 40 cooperate to define a construction such that upon movement of the compressed liner 40 past the ring 43 and removal of the compressive forces such liner 40 expands substantially to its original configuration with the outside surface 57 of the liner against the inside surface 37 of the peripheral flange 36.

Figure 4:
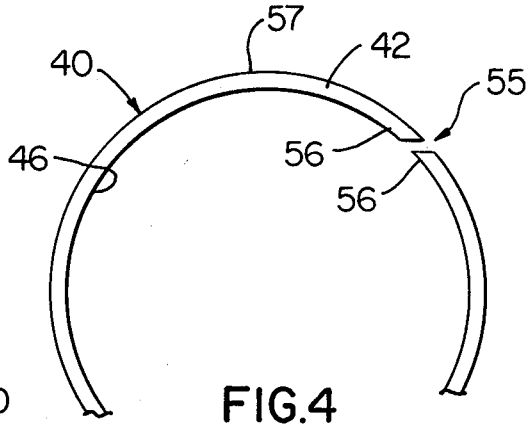
FIG. 4 is a plan view illustrating a fragmentary portion of the tubular liner illustrated in FIGS. 2 and 3.

As will be readily apparent from FIG. 4 of the drawing, the cut at 55 in the tubular liner 40 is disposed at an angle to a radial plane through the liner and thereby defines the free ends 56 as beveled ends. Each of the beveled ends 56 has opposed surfaces defining same which are disposed in a V-shaped pattern having an included angle therebetween of roughly 45°.

Having described the railway vehicle center plate structure and associated wear resistant tubular liner 40 in the form of a reinforced liner it will be appreciated, as mentioned earlier, that such liner need not necessarily be reinforced. Accordingly, reference is now made to FIGS. 5 and 6 of the drawing which show a modification of the liner 40 which is substantially identical to the liner 40 with the exception that it is made free of reinforcing material. Because the modified liner of FIGS. 5 and 6 is made entirely of polymeric material 44, such material will generally have a greater tendency to cold flow once the modified liner 40 is compressed between the surfaces 33 and 37.

Figure 5:
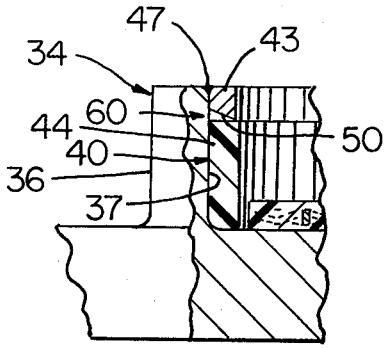
FIG. 5 is a view with parts in elevation, parts in cross section, and parts broken away illustrating a modified metal ring similar to the ring of FIG. 3 for retaining a modified tubular liner in position.
Figure 6:
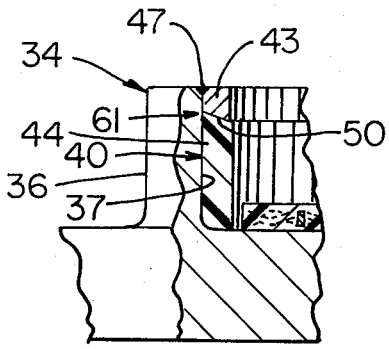
FIG. 6 is a view illustrating the components of FIG. 5 after vertical cold flow of polymeric material comprising the tubular liner.

The liner 40 of FIGS. 5 and 6 may use the ring 43 of FIG. 3, however, such liner is shown being used with a modified metal ring 43. The modified ring is also welded in position by weld means 47 and such ring has a bottom surface 50 which is in the form of a substantially frustoconical surface. The frustoconical surface 50 has a central axis which coincides with a central vertical axis 51 through the bolster bowl; and, the frustoconical surface 50 of FIGS. 5 and 6 is inclined so that it faces away from the vertical axis 51 and thereby defines a cam surface which serves to urge the top portion of the liner 40 radially toward the flange 36.

The liner 40 when used with the modified ring 43 of FIGS. 5 and 6 initially leaves a void space 60, as shown in FIG. 5, once such liner is initially installed in position. However, with normal use of the car 20 there is cold flow of the polymeric material defining such liner and the void space 60 is filled with polymeric material, as illustrated at 61 in FIG. 6. This filling of void or volume 60 results in the top portion of the liner being held in position in a high strength manner.

In all other respects, the modified liner 40 of FIGS. 5 and 6 is substantially identical to the previously described liner 40. Accordingly, such modified liner has the angled cut therein similar to the cut at 55 in FIG. 4 and for the same purposes as described earlier. Also such modified liner is substantially the same dimensionally as the liner of FIG. 3.

The reinforced liner 40 of FIG. 3 has been shown used with the ring 43 having planar annular bottom surface 50. However, such reinforced liner may also be used with the ring 43 having a frustoconical bottom surface, if desired.

It will also be appreciated that the tubular liner 40 need not necessarily be split in the manner described previously and for the purposes described above. Indeed, it may be possible in some applications of this invention to define the liner 40 of an ultra high molecular weight polymeric material either with or without reinforcement as a continuous tubular liner. Such a continuous (unsplit) liner may be disposed in position beneath the metal ring 43 simply by temporarily distorting same and forcing it in position. The construction of such a continuous liner would be such that it would not be permanently deformed by the forcing action.

The above description has proceeded without a description of a center pin 62 associated with each truck 24 and a disc-like center plate liner 63 for use in the bolster bowl 34. However, it is to be understood that the center pin 62, which is also referred to in the art as a king bolt 62, has an upper portion which extends through an opening or bore 64 through the car body center plate 23 and continues through the car body bolster 22. The bottom portion of the center pin 62 extends through a blind opening or bore 65 which extends through the truck center plate and terminates at a blind surface in the bolster 30.

Each truck 24 turns about its associated center pin 62 which serves as a safety pin and, as is known in the art the entire load at each end of the railway car is taken by a body center plate 23 and an associated bolster bowl 34. The side loads at each end of the car 20 are taken by a liner 40. The vertical load is taken by a disc-like center plate liner 63 provided between a pair of surfaces 35 and 32. The liner 63 is preferably of the type disclosed in the abovementioned U.S. Pat. No. 4,188,888; and, it will be appreciated that liner 63 has a central bore 67 therein for receiving the center pin 62 in an unobstructed manner therethrough. It will also be noted that the liner 63 has a right circular cylindrical outside surface 70 (FIG. 3) which has a diameter such that it is disposed radially inwardly of the inside surface 46 of its tubular liner 40 and as shown typically at 71 in FIG. 3.

As previously indicated, the tubular liner 40 is made of polymeric material 44 and preferably such polymeric material is an ultra high molecular weight polymeric material such as polyethylene. However, any suitable ultra high molecular weight polymeric material may be used for this purpose. In addition, the molecular weight referred to is a molecular weight of at least two million with the preferred molecular weight being in the range of two to five million. However, such molecular weight may be much greater than five million. In addition, it is to be understood that this reference to molecular weight means average molecular weight and the technique for determining such molecular weight is referred to as the intrinsic viscosity test which is widely used in the United States.

While present exemplary embodiments of this invention, and methods of practicing the same, have been illustrated and described, it will be recognized that this invention may be otherwise variously embodied and practiced within the scope of the following claims.

What is claimed is:

1. In a method of resisting wear between a body center plate provided on a body bolster of a railway vehicle body and a bolster bowl provided on a truck bolster of a truck of said railway vehicle, said body center plate having a supported planar bottom surface adjoined by a cylindrical outside surface and said bolster bowl having a planar supporting surface adjoined by an upstanding peripheral flange which has a cylindrical inside surface which is adapted to receive said outside surface therewithin, said method comprising the step of disposing a wear resistant tubular liner against said cylindrical inside surface so that said liner is sandwiched between said cylindrical surfaces with said body center plate disposed within said bolster bowl, said tubular liner being comprised of an ultra high molecular weight polymeric material and having a top surface, the improvement in said method comprising the step of fixing a continuous metal ring to said flange against a top portion of said inside surface before said step of disposing said liner, said ring serving to engage said top surface of said tubular liner and prevent vertical cold flow of the polymeric material comprising same from between said cylindrical surfaces.

2. A method as set forth in claim 1 and comprising the further step of forming said ring of ferrous metal and said fixing step comprises welding said ring against said top portion of said inside surface.

3. A method as set forth in claim 2 in which said forming step comprises forming a continuous annular bottom surface on said ring which is adapted to be engaged by said top surface of said tubular liner and prevent said cold flow.

4. A method as set forth in claim 3 and comprising the further step of constructing said liner with integral reinforcing means.

5. A method as set forth in claim 3 and comprising the further step of cutting said liner to facilitate placement thereof during said disposing step, said cutting step comprising providing a cut through said liner so that said cut extends completely through the vertical height and thickness thereof to thereby define a pair of free ends of said tubular liner, and said disposing step comprises moving said free ends past each other to contract said liner so that it has an outside diameter which is smaller than its normal outside diameter, moving said smaller outside diameter tubular liner past said ring with said body center plate removed, and releasing said liner allowing expansion thereof so that the outside surface of said liner engages said cylindrical inside surface of said upstanding peripheral flange.

6. A method as set forth in claim 5 in which said step of providing said cut comprises providing said cut at an angle to a radial plane through said liner to thereby define said free ends as beveled ends.

* * * * *